United States Patent [19]

Tikes et al.

[11] Patent Number: 4,985,659

[45] Date of Patent: Jan. 15, 1991

[54] TRAVELLING WAVE TUBE PROVIDED WITH AN IMPERVIOUS COUPLING DEVICE BETWEEN ITS DELAY LINE AND AN EXTERNAL MICROWAVE CIRCUIT

[75] Inventors: Jacques Tikes, Orsay; Joël Le Fur, Richebourg; Pierre Nugues, Auneau, all of France

[73] Assignee: Thomson-CSF, Puteaux, France

[21] Appl. No.: 419,326

[22] Filed: Oct. 10, 1989

[30] Foreign Application Priority Data

Oct. 11, 1988 [FR] France ..... 88 13342

[51] Int. Cl.[5] ..... H01J 23/42

[52] U.S. Cl. ..... 315/3.5; 315/39.3; 333/252

[58] Field of Search ..... 333/252, 33; 315/3.5, 315/3.6, 39.3, 39.53

[56] References Cited

U.S. PATENT DOCUMENTS

| | | | |
|---|---|---|---|
| 2,770,784 | 11/1956 | Hatch | 333/252 |
| 2,849,651 | 8/1958 | Robertson | 333/35 |
| 2,984,762 | 5/1961 | Haas | 315/3.5 |
| 3,939,443 | 2/1976 | Biro et al. | 333/202 |
| 4,035,687 | 7/1977 | Gross | 315/3.6 X |
| 4,286,239 | 8/1981 | Gross | 333/252 X |

FOREIGN PATENT DOCUMENTS

| | | | |
|---|---|---|---|
| 0274950 | 7/1988 | European Pat. Off. . | |
| 1064117 | 8/1959 | Fed. Rep. of Germany . | |
| 1434049 | 2/1966 | France . | |
| 2054505 | 4/1971 | France . | |
| 2485801 | 12/1981 | France . | |
| 0796883 | 6/1958 | United Kingdom | 333/252 |

*Primary Examiner*—Eugene R. LaRoche
*Assistant Examiner*—Seung Ham
*Attorney, Agent, or Firm*—Oblon, Spivak, McClelland, Maier & Neustadt

[57] ABSTRACT

In a travelling wave tube, the delay line of which is coupled to a transmission line of an external microwave circuit by a coupling pin having a coupling surface that faces an end surface of the transmission line, a microwave window extends between the coupling surface of the coupling pin and the end surface of the transmission line. This window is permeable to the microwave energy and impermeable to the gases. It is fixed imperviously to the travelling wave tube.

2 Claims, 2 Drawing Sheets

TRAVELLING WAVE TUBE PROVIDED WITH AN IMPERVIOUS COUPLING DEVICE BETWEEN ITS DELAY LINE AND AN EXTERNAL MICROWAVE CIRCUIT

BACKGROUND OF THE INVENTION

1. Field of the Invention

The present invention concerns a travelling wave tube provided with an impervious coupling device between its delay line and an external microwave circuit.

The invention can be applied, particularly, to wide-band power travelling wave tubes, the delay line of which has the shape of a helix structure or a shape derived from a helix.

2. Description of the Prior Art

A travelling wave tube of this type essentially comprises:

- an electron gun designed to emit an electron beam in an essentially rectilinear direction;
- a delay line placed downstream of the electron gun and enclosed in a cylindrical sheath which is concentric with it. The electron beam is emitted in the extension of the longitudinal axis of the delay line, which it crosses from end to end. It is therefore in the sheath of the delay line that the interaction occurs between the electron beam and a microwave guided by the delay line. The delay line is provided with an injection device and with a device for the extraction of microwave energy;
- a permanent-magnet focusing structure, concentric with the sheath of the delay line and extending over the entire length of the delay line. This focusing structure creates a magnetic field in the sheath of the delay line, and this magnetic field has the effect of keeping the paths of the electrons of the electron beam rectilinear;
- a collector designed to collect the electron beam downstream of the delay line.

The travelling wave tube is generally connected to external microwave circuits, on the incoming side of the delay line as well as on its outgoing side, by means of a linking element forming one end of a transmission line of these circuits. On the incoming side of the delay line, this linking element, through which the microwave energy is injected, generally has the structure of a coaxial line, since the level of energy to be injected is low. On the outgoing side of the delay line, this linking element, through which the amplified microwave energy is extracted, has the structure of either a delay line or a ridged wave guide, depending on the level of the energy to be extracted.

In a known way, the electromagnetic coupling between a connecting element and an end of the delay line is done by means of a coupling pin having one end brazed to the corresponding end of the helix forming the delay line, and having a coupling surface located so that it faces an end surface of the central conductor or of the ridge of the linking element, with no mechanical contact being set up between the coupling pin and the linking element.

The different elements of the travelling wave tube and the linking elements form a set with communicating cavities. The parts of this set are assembled imperviously, and the set is itself sealed hermetically so that the high vacuum ($10^{-8}$ to $10^{-9}$ Torr) needed for the working of the electron gun can be created in its cavities. That end of the linking elements which is opposite the travelling wave tube is thus blocked by a window, called a microwave window, which is permeable to the microwave energy and impermeable to the gases.

This arrangement of a travelling wave tube and of the linking elements to the external circuits, which forms part of the prior art, has a major drawback.

For, the volume of gas to be pumped in all the cavities of the travelling wave tube and of the linking elements is generally far greater than the volume of the cavities where it is functionally necessary to create a vacuum, namely, the cavities through which the electrons travel. In fact, it is not rare for the internal volume of a linking element to be of the same magnitude as the internal volume of the travelling wave tube itself. Since the pumping is most usually done at the sheath of the delay line, the internal dimensions of which inasmuch as it demarcates the interactive zone of the tube, are inversely proportionate to the working frequency of the tube, the pumping time for the high frequency tubes reaches values that are incompatible with the requirements of industrial-scale production. Furthermore, the vacuum obtained is not always as high as would be desirable.

SUMMARY OF THE INVENTION

It is to overcome these drawbacks that the present invention provides for a travelling wave tube with an impervious couplinqg device between its delay line and the transmission line of an external microwave circuit.

The invention can be applied to a travelling wave tube including a delay line contained in a sheath, and a coupling pin to couple the delay line with a transmission line of an external microwave circuit, the transmission line including an internal conductive core that has an end surface, the coupling pin having a coupling surface located so as to be facing the end surface of the conductive core of the transmission line.

According to the invention, this travelling wave tube includes a microwave window with a wall permeable to microwave energy, extending between the coupling surface of the coupling pin and the end surface of the conductive core of the transmission line. The microwave window is impermeable to the gases and is fixed to the travelling wave tube imperviously with respect to the gases.

Through this arrangement, the pumping of the gases contained in the travelling wave tube creates a vacuum only in the travelling wave tube itself, and the time necessary for this operation is considerably reduced with respect to the time taken for the pumping of the travelling wave tubes in the prior art.

The invention shall be explained in detail hereinafter, by means of a description of a preferred embodiment of the invention.

BRIEF DESCRIPTION OF THE DRAWINGS

This description shall be made with reference to the appended drawings, of which.

DESCRIPTION OF PREFERRED EMBODIMENTS

Figure 1:
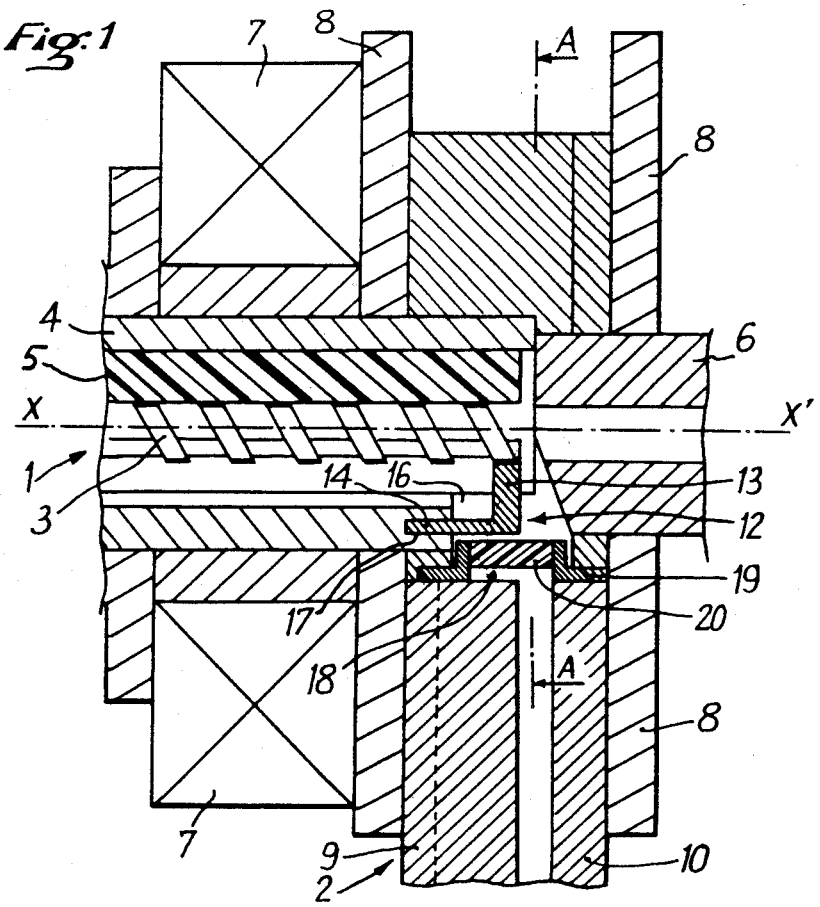
FIG. 1 is a partial schematic view, in a longitudinal section, of a travelling wave tube including an impervious coupling device between a helix-structured delay line and a ridged waveguide.

FIG. 1 shows that part of a travelling wave tube which is located at the level of the junction between the delay line 1 of the tube and an external circuit for the extraction of the microwave energy from the tube.

The delay line 1 comprises a helix 3 with an axis X—X'. The helix 3 is made of copper, for example, and is kept in the center of a cylindrical, metallic sheath 4 by three insulating support rods 5 offset by 120 degrees with respect to one other. The rods 5 which may be, for example, made of quartz, alumina, beryllium oxide or boron nitride, are brazed or clamped to the helix 3. The end of the sheath 4, located on the outgoing side of the delay line 1 (end shown in the figure) abuts one end of a cylindrical conduit 6 which extends up to the collector (not shown) of the travelling wave tube.

A focusing structure is placed concentrically with respect to the sheath 5 and the conduit 6. This focusing structure is formed by the succession, along the axis X—X', of annular permanent magnets, two neighbouring magnets having their polarities reversed. The magnets 7 are separated from one another by annular pole pieces 8.

A transmission line of an external circuit for the extraction of the microwave energy from the travelling wave tube is coupled to the delay line 1. At the tube, the transmission line has a linking element 2 having the shape of a ridged, rectangular waveguide. This linking element is used to set up the junction between the delay line 1 and a waveguide (not shown) of the external circuit. The linking element 2 has a bottom 9 and a cover 10 the bottom having an E-shaped section and including a base, two perpendicular fins 21 at the base, and a ridge 11 equidistant from the fins 21. The ridge 11 forms a conductive core. The linking element 2, the end of which is defined by a cross section, extends between two pole pieces 8 of the focusing structure, and its longitudinal axis is the perpendicular axis X—X' of the delay line.

The microwave coupling between the delay line 1 and the linking element 2 is set up by means of a metallic coupling pin 12 with two plane, perpendicular fins. One fin 13, which is trapezoid-shaped, is brazed, at its unoccupied end, to the end of the helix 3. The other fin 14, which is rectangular, is fixed to the sheath 4, in the extension of the sheath, at a notch 15 made at the end of the sheath. The notch 15 makes an empty space 16 around the coupling pin. This empty space 16 is used for the impedance matching.

The fin 14 of the coupling pin 12 is fixed to the sheath so as to be parallel to the end cross section of the linking element 2, and so as to be located facing the ridge 11. In the embodiment shown, the sheath 4 has a slot 17 that is made in its thickness and extends parallel to the axis of the sheath. This slot has substantially the same thickness as the rectangular fin 14 of the coupling pin. The end of this fin is plugged into the slot 17, and the fixing of the coupling pin 12 to the sheath 4 is completed by a brazing.

The coupling pin 12 does not set up any mechanical contact between the helix 3 and the ridge 11 of the linking element 2. The electromagnetic coupling is provided by capacitive effect between the external surface of the rectangular fin 14 of the coupling pin 12 and the end surface of the ridge 11, through a microwave window 18 which shall now be considered.

The microwave window 18, which is rectangular and is in the cross section of the linking element 2, has a metallic frame 19, made of ferronickel for example, and a flat plate 20, made of a low loss dielectric material, high-purity alumina or sapphire, for example. Advantageously, the plate 20 is fixed to the frame 19 by a brazing done on the edge. The window thus made is permeable to microwave energy and impermeable to gases.

The window 18 is imperviously fixed by its frame to the travelling wave tube, between the two pole pieces 8 where a part of the linking element 2 extends. The window 18 is fixed so as to be facing the coupling pin 12 so that its plate 20 is parallel to the rectangular fin 14, namely also to the end cross section of the linking element 2 The interstice between the internal surface of the plate 20 and the facing surface of the rectangular fin 14 of the coupling pin is also chosen to be as narrow as possible. The same is true for the interstice between the external surface of the plate 20 and the end cross section of the ridge 11. To this effect, when the frame 19 is thicker than the plate 20, as is the case in the embodiment shown, the end of the linking element 2 may be configured so that the ridge 11 projects on the end cross section of the linking element.

For reasons of impedance matching, the end of the tubular conduit 6 is bevelled before the window 18 so that the internal surface of the plate 20 is totally released with respect to the end of the delay line 1.

The mounting of a travelling wave tube including a coupling device, according to the invention, is done as follows:

- positioning and fixing of that part of the focusing structure 8 which is adjacent to the cover 10 of the linking element 2;
- positioning and fixing of that part of the focusing structure 8 which is adjacent to the base 9 of the linking element 2;
- fixing of the microwave window 18 between the two pole pieces of the focusing structure where the linking element 2 should be engaged;
- assembly of the focusing structure 8 and of the linking element 2;
- assembly and brazing of the previously assembled set, formed by the delay line 1, the sheath 4 and the coupling pin 12 to the set formed by the focusing structure 8 and the linking element 2. With respect to the first of these sets, the assembly is done as follows: the coupling pin 12 is brazed to the sheath 4 and the helix 3 is brazed to the rods 5; the set formed by the helix 3 and the rods 5 is introduced into the sheath 4 and brazed therein. Finally, the end of the helix 3 is brazed to the coupling pin 12.

Because there is no mechanical link between the delay line 1 and the linking element 2, the measurements to check that the various sets of elements work properly are advantageously done before the brazing, at the general assembly stage. Thus, defective elements or sets can be rejected before the final assembly. When the measurements give positive results, the stage for assembling the above-mentioned two sets of elements is completed by brazing. After this, the electron gun and the collector are mounted respectively on either side of the delay line. Finally, the cavities of the travelling wave tube are emptied of the gases that they contain.

Figure 2:
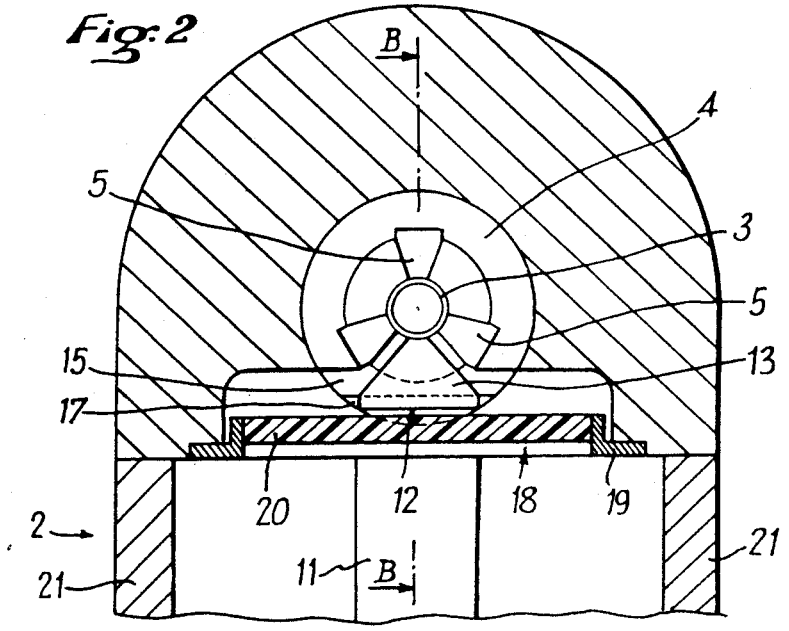
FIG. 2 is a partial cross section view of the travelling wave tube shown in FIG. 1.
Figure 3:
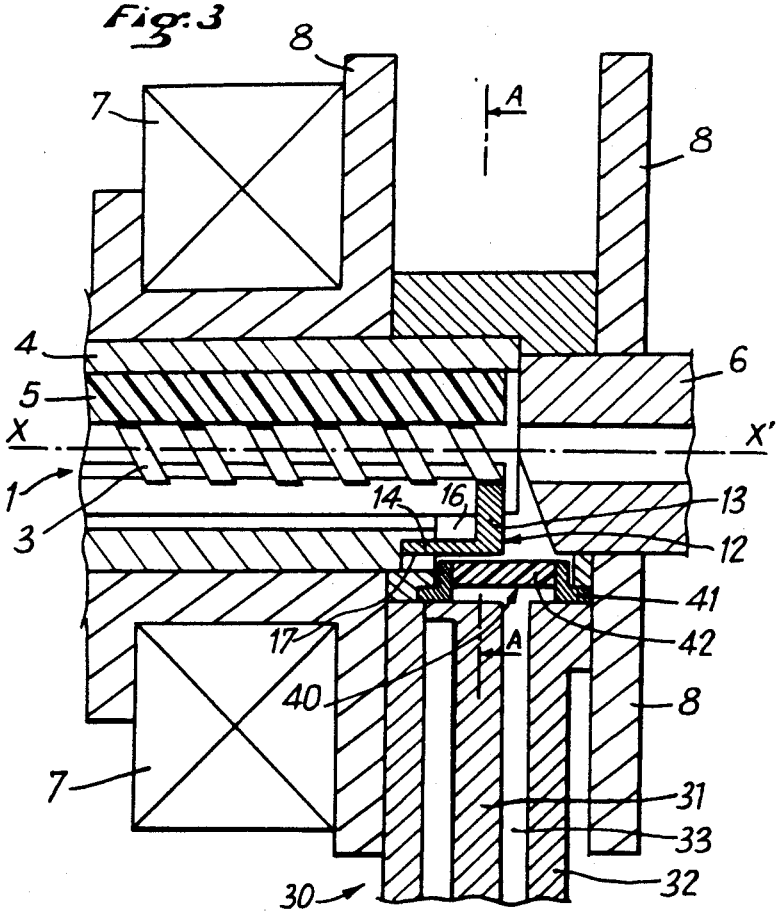
FIG. 3 is a partial schematic view, in a longitudinal section, of a travelling wave tube including a coupling device, according to the invention, between a helix-structured delay line and a coaxial line.
Figure 4:
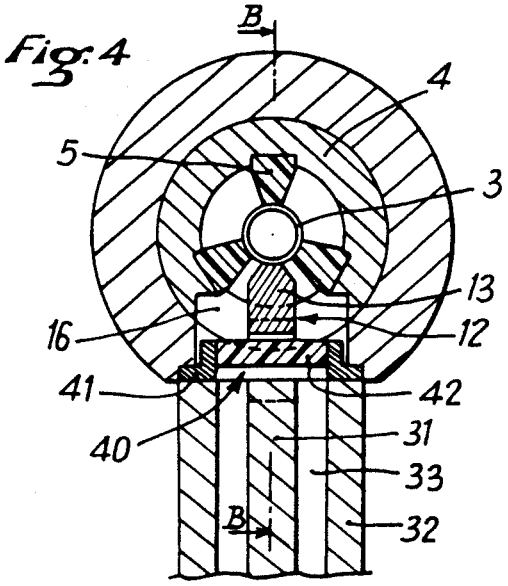
FIG. 4 is a partial cross section view of the travelling wave tube shown in FIG. 3.

FIGS. 3 and 4 show another embodiment of the invention, adapted to the case where the linking element of the external circuit includes a coaxial line element. In these figures, those parts of the travelling wave tube that are identical to the parts of the travelling wave tube shown in FIGS. 1 and 2 have been designated by the same reference numbers. It is seen that these two embodiments do not differ in the number or respective arrangement of their elements, but in the conforming of two of them, the linking element 30 and the microwave window 40.

The linking element 30 is formed by a central conductor 31 and an external conductor 32 in the form of a hollow cylinder, separated by a dielectric 33. The central conductor 31 forms a conductive core. The window 40, which comprises a metallic frame 41 and a dielectric plate 42, has a circular shape.

The present invention is not restricted to the embodiment that has just been described. It is capable of having variants and modifications that are within the scope of those skilled in the art, without going beyond the framework of the appended claims. In particular, the coupling pin 12 can be fixed by means of a ring brazed to the end of the sheath 4, the coupling pin extending radially towards the interior from the periphery of the ring. The transmission line of the external microwave circuit could be connected directly to the travelling wave tube without using a linking element. The facing surfaces of the coupling pin, the linking element and the microwave window could be parallel to a plane that is oblique to a cross section of the linking element. These same surfaces may also be non-plane and could have a slight curvature.

What is claimed is:

1. A travelling wave tube comprising:

a delay line contained in a sheath, located along a first direction;

a coupling pin, connected to the delay line, to couple the delay line with a transmission line of an external microwave circuit;

the transmission line being located along a second direction different from the first direction, and possessing an internal conductive core which has an end surface;

the coupling pin having a coupling surface located so that it faces the end surface of the conductive core said coupling pin and said conductive core being mechanically independent;

wherein a vacuum-tight window with a wall permeable to microwave energy, is tightly fixed to said travelling wave tube, said vacuum-tight window extending between the coupling surface of the coupling pin and the end surface of the conductive core, and being mechanically independent from said coupling pin and from said conductive core.

2. A travelling wave tube according to claim 1, wherein said vacuum-tight window is within a cross section of the transmission line.

* * * * *